US012723835B1

(12) United States Patent
Sun

(10) Patent No.: US 12,723,835 B1
(45) Date of Patent: Sep. 1, 2026

(54) MAGAZINE-TYPE SLINGSHOT

(71) Applicant: Zhongcheng Sun, Weifang (CN)

(72) Inventor: Zhongcheng Sun, Weifang (CN)

( * ) Notice: Subject to any disclaimer, the term of this patent is extended or adjusted under 35 U.S.C. 154(b) by 0 days.

(21) Appl. No.: 19/571,447

(22) Filed: Mar. 18, 2026

(30) Foreign Application Priority Data

Nov. 20, 2025 (CN) ..... 202522467020.6

(51) Int. Cl.
*F41B 3/02* (2006.01)

(52) U.S. Cl.
CPC ..... *F41B 3/02* (2013.01)

(58) Field of Classification Search
CPC ..... F41B 3/02
See application file for complete search history.

(56) References Cited

U.S. PATENT DOCUMENTS

2008/0053421 A1* 3/2008 Chang ..... F41A 9/64
124/45

FOREIGN PATENT DOCUMENTS

CN 111721158 A * 9/2020 ..... F41B 3/02
CN 216432679 U * 5/2022
CN 223525670 U 11/2025
GB 2513423 A * 10/2014 ..... F41B 3/02

* cited by examiner

*Primary Examiner* — Yingchuan Zhang

(57) ABSTRACT

A magazine-type slingshot includes a bow body used for mounting a pouch rubber band assembly. The bow body is provided with a magazine, which has an opening and is used for holding marbles, the bow body is further provided with a marble driving assembly used for driving at least one marble within the magazine toward the opening and causing a marble closest to the opening to be expelled from the opening; an upper side of the bow body is provided with a pouch initial position, when a rubber band of the mounted pouch rubber band assembly is in an unstretched state, the pouch is in the pouch initial position, and when the marble is expelled from the opening, the marble moves toward the pouch initial position; and the marble driving assembly is used for driving the marble to open the opening and then expel.

10 Claims, 12 Drawing Sheets

C-C

I

D–D

MAGAZINE-TYPE SLINGSHOT

CROSS REFERENCE TO RELATED APPLICATIONS

This application claims foreign priority of Chinese Patent Application No. 202522467020.6, filed on Nov. 20, 2025 in the China National Intellectual Property Administration, the disclosures of all of which are hereby incorporated by reference.

TECHNICAL FIELD

The present application relates to the technical field of slingshots, and more particularly, to a magazine-type slingshot.

BACKGROUND OF THE PRESENT INVENTION

Slingshot is a very common toy and has also become increasingly popular as fitness device, enjoying widespread appeal. A traditional slingshot typically consists of a bow body, a rubber band, and a pouch. When shooting, it is necessary to put the marble into the pouch, and then stretch the rubber band before launching. This way of loading marbles is slow, and it is difficult to launch quickly, which is not good for beginners to launch quickly. At present, there are also slingshots with a magazine, but it is still necessary to manually take the marbles out and put the marbles into the pouch, which remains a slow and inefficient reloading process.

SUMMARY OF PRESENT INVENTION

In order to solve the shortcomings in the prior art, the present application provides a magazine-type slingshot.

The technical solutions of the present application are as follows.

The present application provides a magazine-type slingshot, which includes a bow body used for mounting a pouch rubber band assembly, wherein the bow body is provided with a magazine, which has an opening and is used for holding marbles, the bow body is further provided with a marble driving assembly used for driving at least one marble within the magazine toward the opening and causing a marble closest to the opening to be expelled from the opening; and an upper side of the bow body is provided with a pouch initial position, when a rubber band of the mounted pouch rubber band assembly is in an unstretched state, the pouch is in the pouch initial position, and when the marble is expelled from the opening, the marble moves toward the pouch initial position.

Further, the marble, when expelled from the opening, moves toward the pouch initial position with a certain initial velocity.

Further, the magazine is provided with a retractable opening, which is capable of automatically retracting after being opened, and when the marble is expelled from the opening, the opening retracts to assist the expelled marble to bounce to the pouch initial position.

Further, a magnet is arranged on the pouch, and the marble used is made of a material which is capable of being adsorbed by the magnet.

Further, an elastic member is arranged in the magazine, and the elastic member is used for applying a pushing force to the marble in the magazine toward the opening.

Further, the marble driving assembly includes a driving component, the driving component is movably installed at a side part of the bow body through an elastic component, one end of the driving component is capable of extending into the magazine to drive at least one marble in the magazine to move toward the opening, and the magazine is provided with a first through hole corresponding to the driving component.

Further, the marble driving assembly further includes a limiting component, and after the elastic component makes the driving component leave the magazine, the limiting component keeps the driving component at an initial position through limiting.

Further, an inner end of the driving component is provided with a pressing surface which is non-parallel to a moving track of the pressing surface and used for pushing the marble, and the marble is expelled from the opening by pressing the marble through the pressing surface.

Further, both sides of the upper part of the bow body are respectively provided with a supporting end, and rubber bands on both sides of the pouch are connected with the bow body after passing through the supporting end on the corresponding side of the bow body.

Further, an accommodating space for accommodating the rubber band is arranged inside the bow body, and two upper openings at an upper part of the accommodating space are respectively located at the two supporting ends.

The present application achieves the following beneficial effects.

The marble driving assembly of the present application is used for driving the marble to open the opening and then expel, and a user can put the expelled marble into the pouch to launch. A retraction force after the opening is opened makes the expelled marble pop out toward the pouch, and the expelled marble is attracted by a magnet, which is arranged in a middle of the pouch, so that the marble can be automatically loaded by the magnet, and the user can directly grasp the pouch to stretch the rubber band and release the rubber band, thus completing the launch of the marble with a fast loading speed.

DETAILED DESCRIPTION OF PREFERRED EMBODIMENTS

Figure 1:
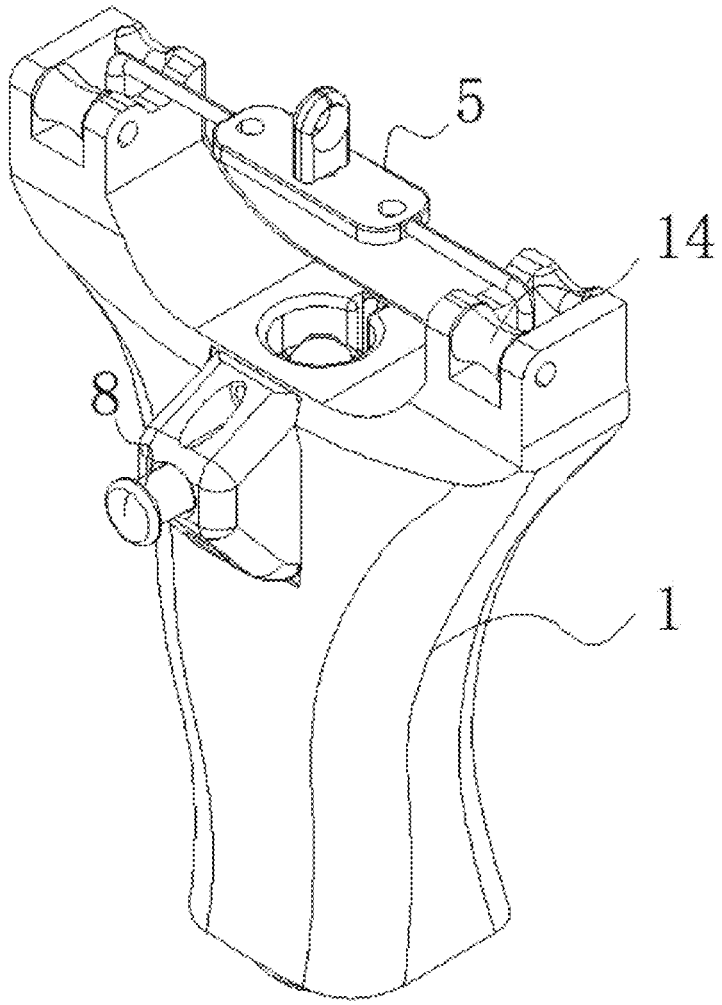
FIG. 1 is a schematic diagram of a first three-dimensional structure according to one embodiment of the present application.
Figure 2:
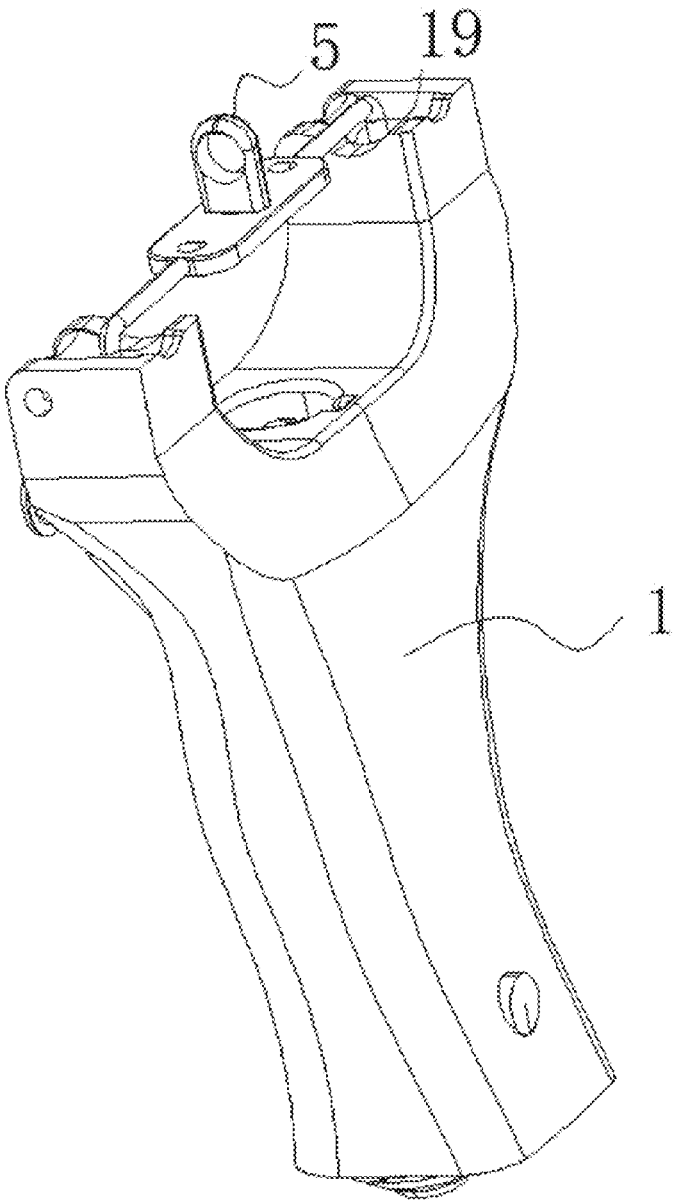
FIG. 2 is a schematic diagram of a pouch at a pouch initial position according to one embodiment of the present application.
Figure 3:
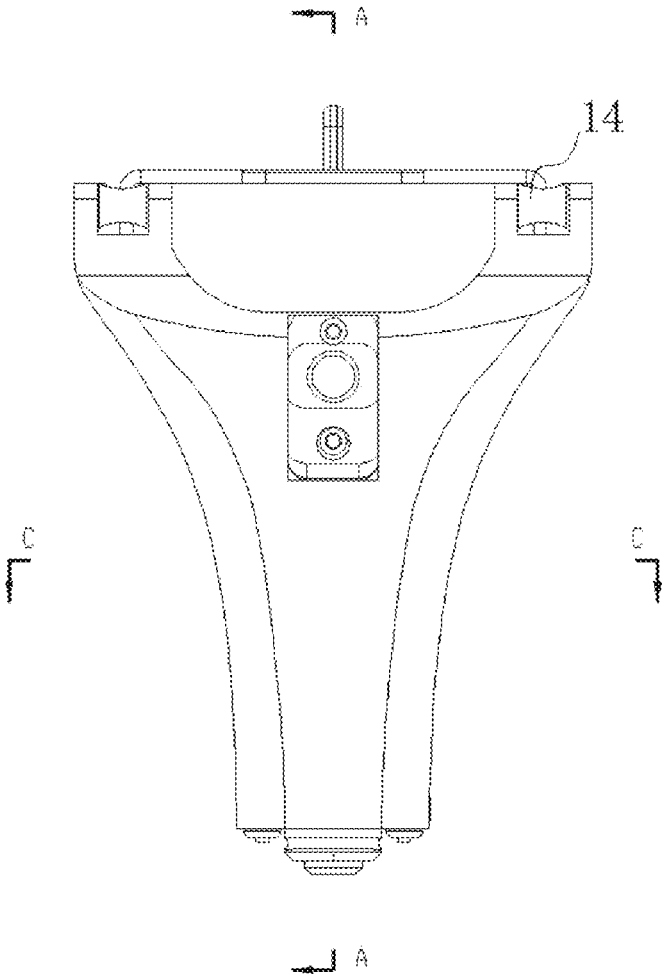
FIG. 3 is a schematic front view of one embodiment of the present application.
Figure 4:
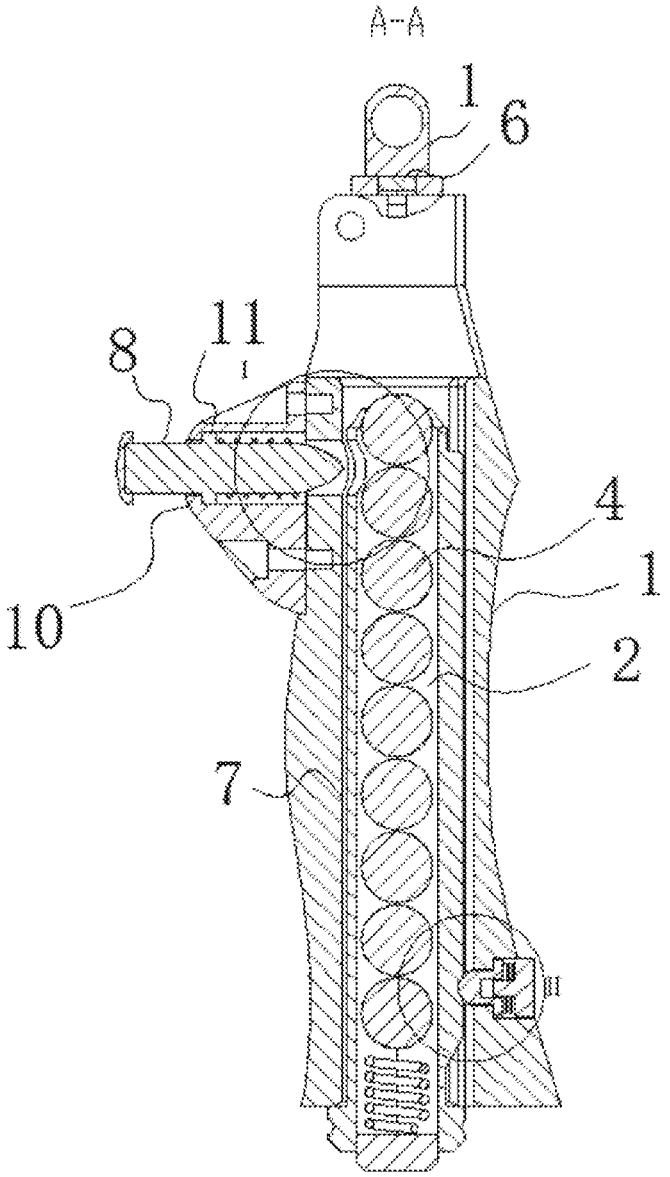
FIG. 4 is a schematic structural view taken along a line A-A of FIG. 3.
Figure 5:
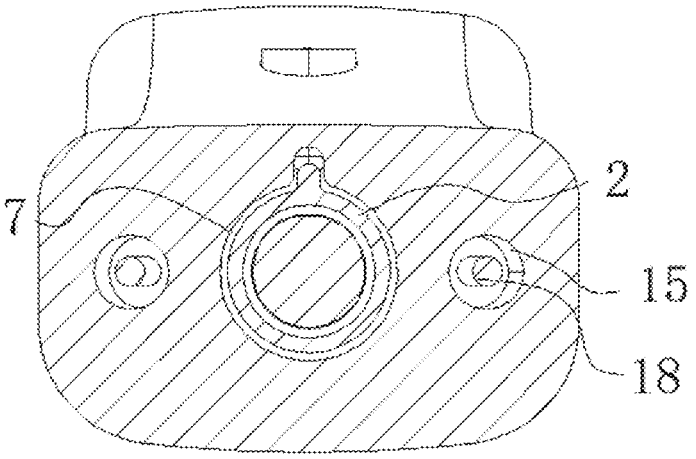
FIG. 5 is a schematic structural view taken along a line C-C of FIG. 3.
Figure 6:
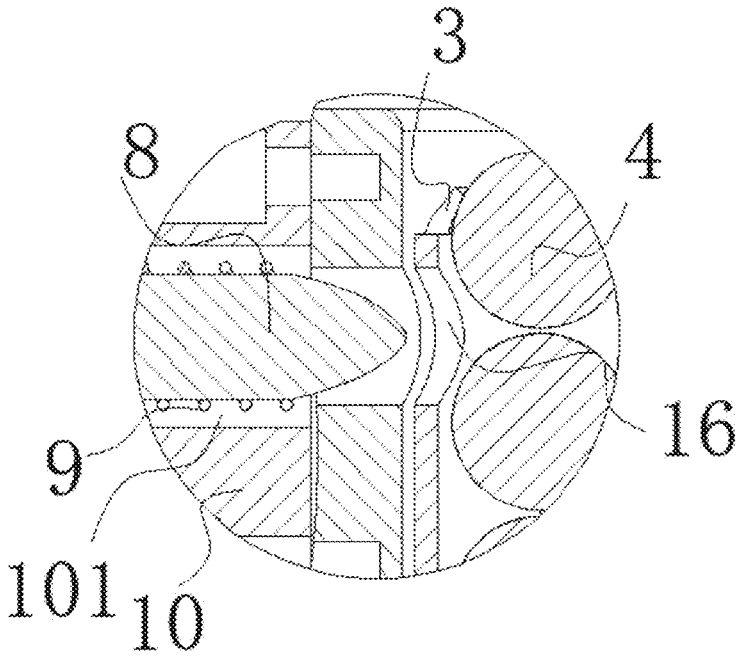
FIG. 6 is a schematic structural diagram of a part I of FIG. 4.
Figure 7:
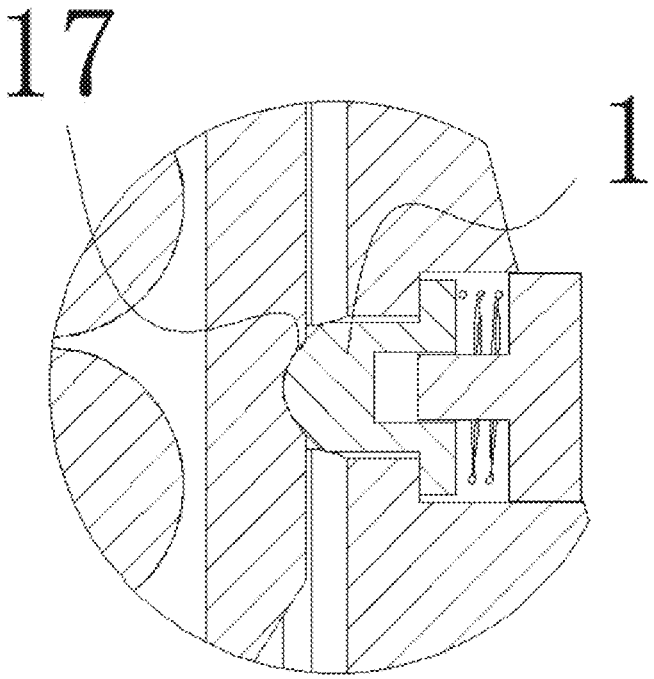
FIG. 7 is a schematic structural diagram of a part II of FIG. 4.
Figure 8:
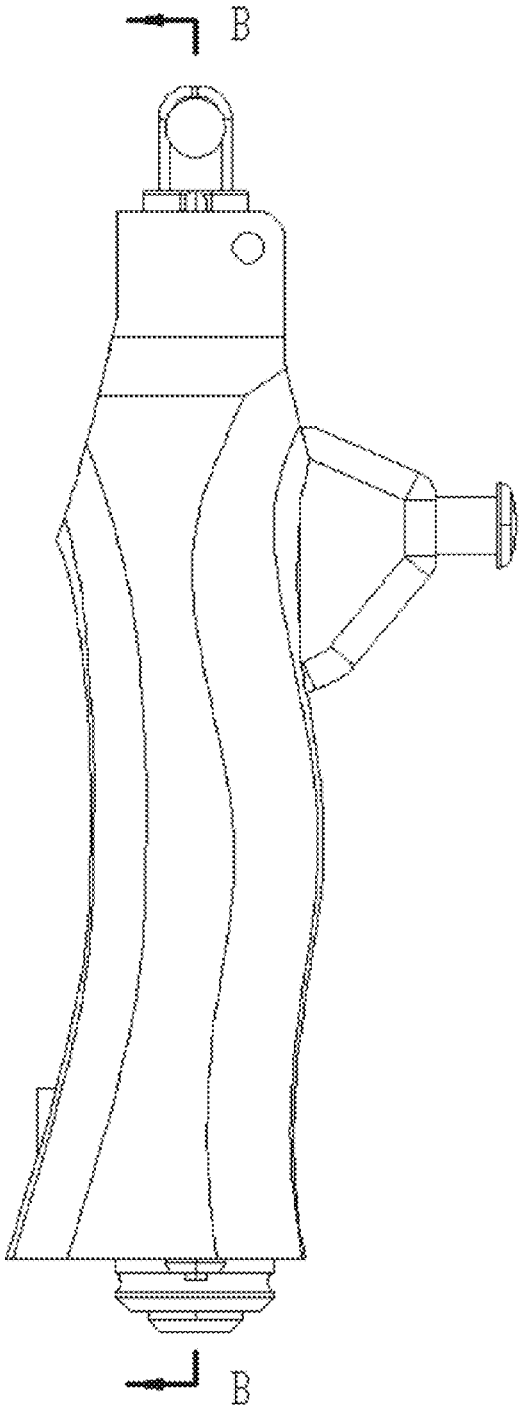
FIG. 8 is a schematic side view of one embodiment of the present application.
Figure 9:
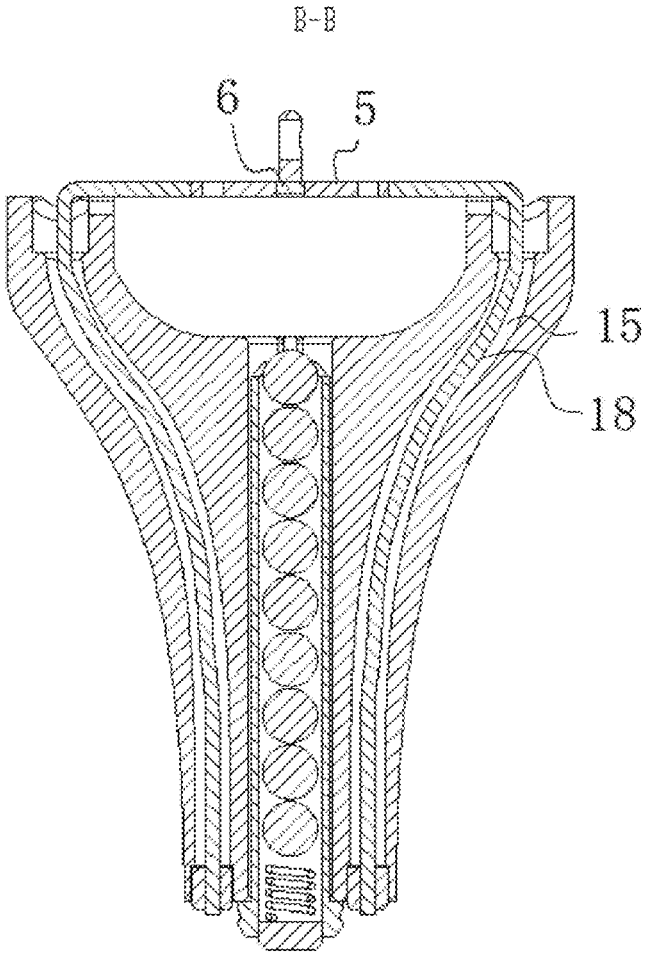
FIG. 9 is a schematic structural view taken along a line B-B of FIG. 8.
Figure 10:
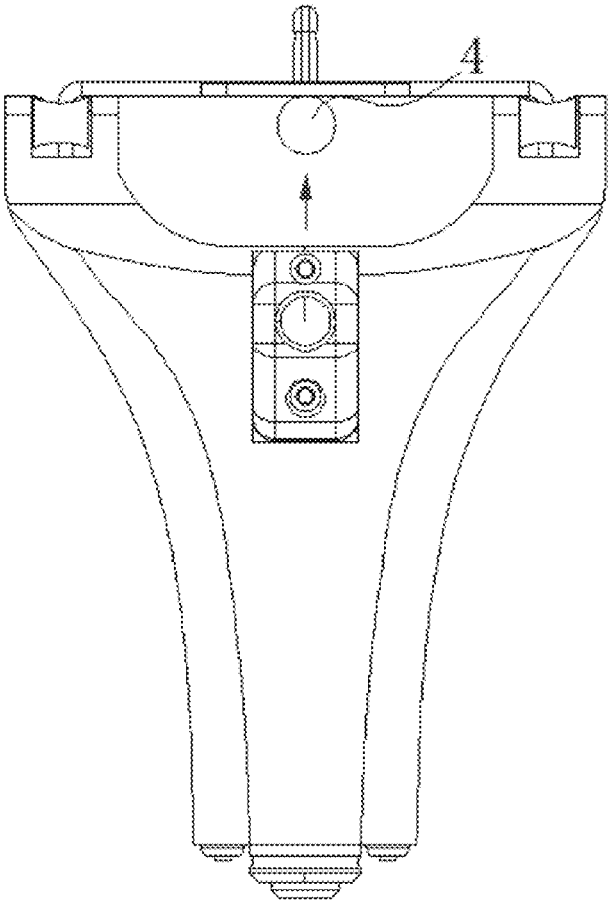
FIG. 10 is a schematic diagram of a state that a marble a is adsorbed to the pouch according to one embodiment of the present application.

In order to facilitate those skilled in the art to understand the present application, the specific implementation of the present application will be described below with the attached drawings.

As shown in FIG. 1 to FIG. 13, the present application provides a magazine-type slingshot.

FIG. 1 to FIG. 10 show one embodiment of the magazine-type slingshot, including a bow body 1. The bow body 1 is provided with a magazine 2. The magazine 2 may be a magazine structure integrated with the bow body or a detachable structure mounted to the bow body. The magazine 2 is used for holding marbles 4. An elastic member is arranged inside the magazine 2, and an upper end of the magazine 2 is provided with a retractable opening 3. The retractable opening does not necessarily mean that the opening itself is inherently retractable, and may also refer to a member provided to reduce a size of the opening. An inner diameter of the opening 3 is smaller than a diameter of the marble 4. When the marble 4 is mounted in the magazine 2, the elastic member is used for applying a pushing force on the marble 4 movably arranged in the magazine 2 toward the opening 3. The bow body 1 is also provided with a pouch rubber band assembly, which includes a pouch 5 and a rubber band 18. One end of the rubber band is connected with the pouch 5, and the other end of the rubber band is connected with the bow body. An upper side of the bow body 1 is provided with a pouch initial position. When the rubber band is in an unstretched state, the pouch is at the pouch initial position, and the pouch at the initial position is located at the opening 3, and the pouch at the pouch initial position is preferably arranged above the opening 3.

The bow body 1 is further provided with a marble driving assembly used for driving at least one marble within the magazine toward the opening 3 and causing a marble closest to the opening 3 to be expelled from the opening 3, so that the user may put the expelled marble into the pouch to launch.

The opening 3 of the magazine can automatically retract after being opened. Preferably, a retracted part of the opening 3 is made of an elastic material. When the marble is expelled from the opening 3, the retraction of the opening 3 after being opened gives the expelled marble a force to pop up toward the pouch initial position. The force may help the marble to shoot toward the pouch. For example, the pouch is provided with a magnet 6, and the marble is made of a material that may be adsorbed by the magnet, such as a steel ball. The expelled marble is adsorbed by the magnet, which is arranged in a middle of the pouch. The marble is automatically loaded by the magnet, and the user can directly grasp the pouch to stretch the rubber band and release to launch. Alternatively, the pouch is provided with a sticky material, and the marble is made of a material which can be absorbed by the sticky material. After the marble moves to the pouch initial position, the pouch absorbs the marble, so the marble may be connected with the pouch after moving to the pouch initial position, or may be connected in any other way, for example, the pouch can automatically clamp the marble.

A side part of the retractable opening 3 is provided with a notch, which makes the opening 3 an incomplete circle. When the marble is expelled from the opening 3, the notch may be arranged to facilitate deformation of the opening 3 and avoid the opening from cracking. After the marble is expelled, the retraction force can better assist in popping up the marble.

Figure 12:
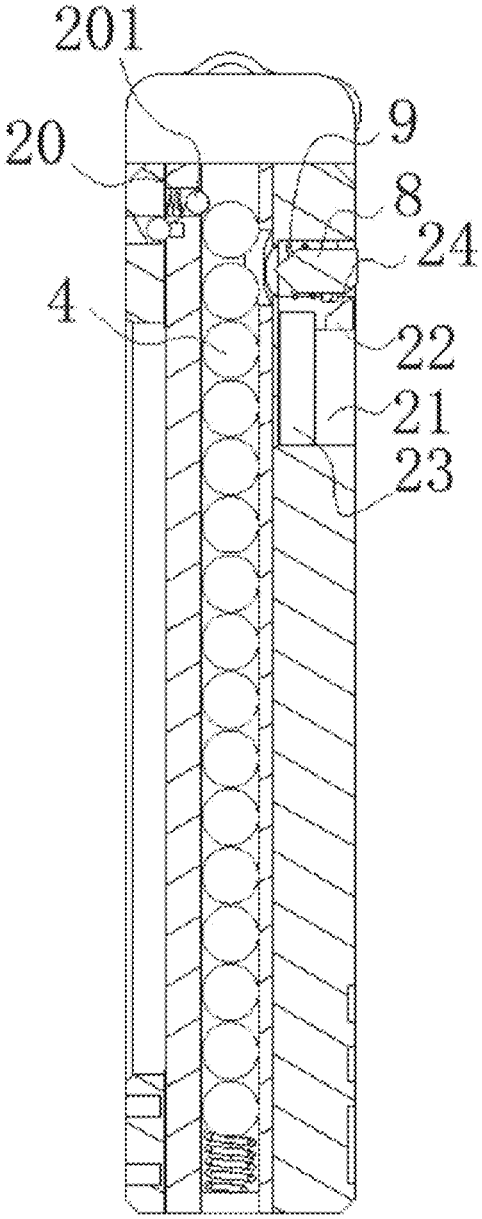
FIG. 12 is a sectional view taken along a line D-D of FIG. 11.

As shown in FIG. 12, the retractable opening of the magazine may also be realized by installing an inward elastic positioning piece 20 on the side part. The magazine has a chamber with a certain length for accommodating the marble, and part of the elastic positioning piece 20 overlaps with a length direction of the chamber. For example, the elastic positioning piece 20 may directly extend into the chamber, or the elastic positioning piece 20 may be arranged outside the opening 3 on an extension line of the chamber to the outside, and the elastic positioning piece has a certain deformation ability along a radial direction of the chamber. The elastic positioning piece provides a certain resistance for the marble in the chamber to be expelled from the opening.

The elastic positioning piece includes a thimble 201 and a third spring. The thimble is installed in an installing hole of a side wall of the chamber and partially extends into the chamber. The third spring is installed in the installing hole to apply a force to the thimble toward the chamber. When the marble passes over the thimble, firstly, the third spring is passively shortened, and the thimble retracts; after the marble passes over, the thimble is reset under an action of the third spring, and resistance is continuously applied to next marble, which pertains to the prior art. A positioning ball assembly self-provided with a spring may also be selected, which will not be described here.

The bow body 1 is provided with a cavity 7 for accommodating the magazine. A shape of the cavity 7 is matched with that of the magazine, and an upper end of the cavity is open. After the magazine 2 is installed in the cavity, the opening 3 is located at an upper end of the cavity, preferably inside the cavity.

One embodiment of the marble driving assembly is a manual driving mode. The marble driving assembly includes a driving component 8 which is movably installed at the side part of the bow body through an elastic component 9. One end of the driving component 8 can extend into the magazine to drive at least one marble in the magazine to move toward the opening 3. The magazine is provided with a first through hole 16 corresponding to the driving component 8, and the driving component can squeeze and expel the marble near the opening to the opening end only by extending between two marbles.

The marble driving assembly further includes a limiting component 10 which is matched with the limiting component 8. When the user does not drive the driving component 8, after the elastic component 9 makes the driving component 8 leave the magazine, the limiting component 10 keeps the driving component at an initial position through limiting. The elastic component 9 is a first spring, and an installation mode of the first spring is not limited. One end of the first spring may be connected with the bow body, and the other end of the first spring may be connected with the driving component. The bow body is provided with a second through hole corresponding to the driving component. When the user presses an outer end of the driving component, the first spring is compressed, and meanwhile, an inner end of the driving component passes through the second through hole and the first through hole and then extends into a non-center of the magazine to contact the marble. The inner end of the driving component is provided with a pressing surface which is non-parallel to a moving track of the driving component for pushing the marble, and at least a part of the pressing surface faces towards the opening 3, so that the marble can be expelled from the opening 3 by pressing the marble through the pressing surface, and the driving component 8 is driven to have a certain speed, so that the marble can be popped up from the opening with a certain initial speed and a certain height.

An installing hole 101 is arranged in the limiting component 10, and the driving component 8 is movably arranged in the installing hole. The limiting component is fixedly installed at the side part of the bow body. The driving component 8 has a rod-shaped structure, and a part of the side part of the driving component 8 located in the installing hole is provided with a follower component 11, which is a structure of any shape that protrudes to an outside of the driving component and is configured to be obstructable, such as a stop ring. The installing hole near the outer end can resist the follower component 11 and prevent the driving component from coming out.

Figure 11:
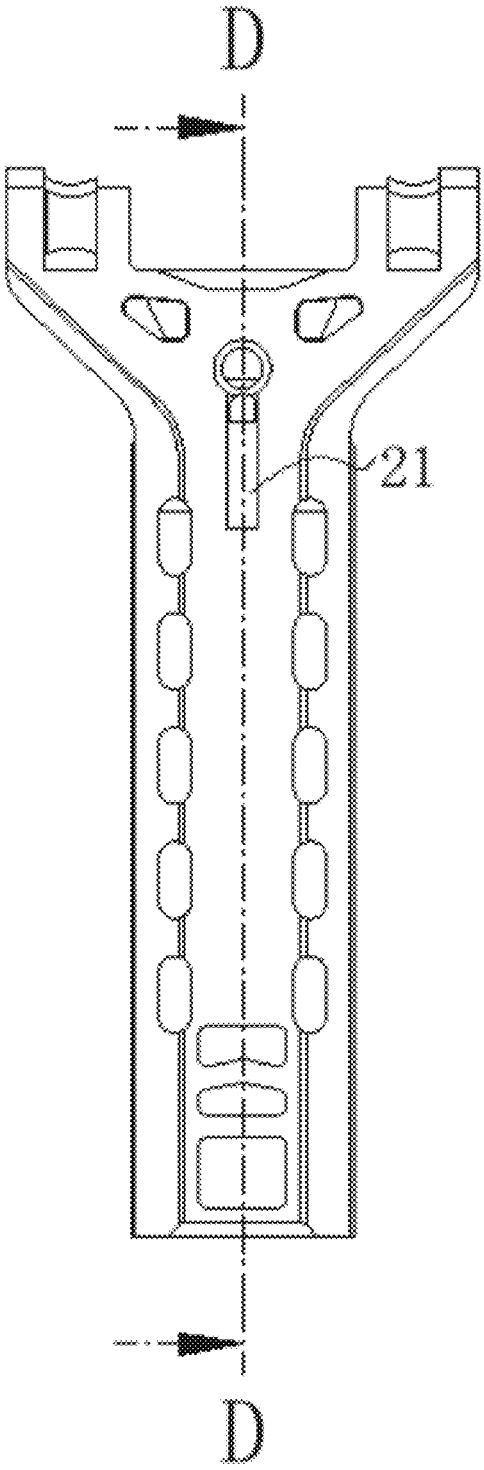
FIG. 11 is a schematic front view of another embodiment of the present application.
Figure 13:
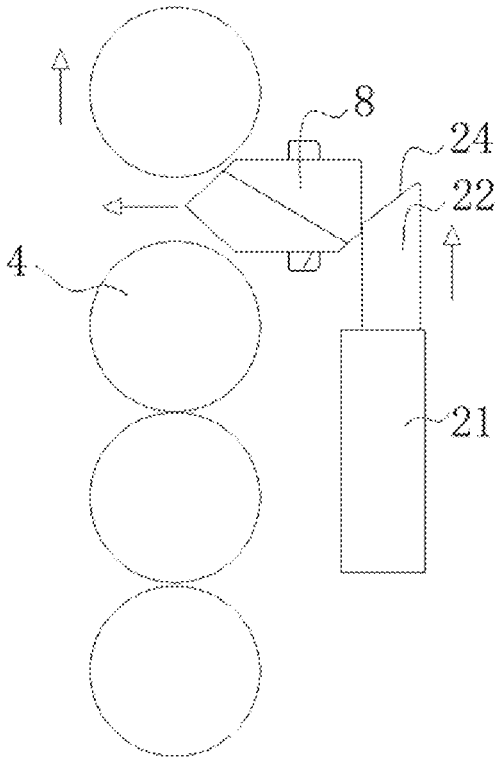
FIG. 13 is a state diagram showing an electric push rod engaged with a driving component in another embodiment of a marble driving assembly.

FIG. 11 and FIG. 12 show another embodiment of the magazine-type slingshot, and shown another shape design of bow body at the same time. Another embodiment of the marble driving assembly is electric drive. The electric drive mode may be electric push, and the driving component 8 with similar functions as that in manual drive mode is still retained. The embodiment includes an electric push rod 21, and extension and contraction of the electric push rod 21 can control reciprocating movement of the driving component 8. When an axial direction of the electric push rod 21 is perpendicular to the driving component 8, a telescopic rod 22 of the electric push rod 21 has an inclined surface 24 which is matched with the driving component 8. The electric push rod is installed in the bow body 1 at one side of the driving component 8. When the telescopic rod 22 of the electric push rod is extended, the inclined surface 24 of the telescopic rod 22 of the electric push rod is matched with the driving component 8. As shown in FIG. 13, the driving component 8 is pushed to move to the inside of the magazine, so that the marble is expelled from the opening 3. When the telescopic rod 22 of the electric push rod 21 is retracted, the driving component 8 is automatically reset under an action of the elastic component 9. The bow body is also provided with a power supply control module 23 connected with the electric push rod, and the electric push rod is controlled to expand and contract by the power supply control module. Both power supply and control are mature technologies, and buttons corresponding to the power supply control module may be arranged on the bow body, which are not shown in the figure. It is only necessary to input instructions through the buttons and then control the expansion and contraction of the electric push rod. For example, if the button is pressed, the electric push rod will automatically retract after one extension, so that the marble can be continuously expelled by reciprocating.

The elastic member is a second spring installed at a bottom part of the magazine. When the marble is loaded, the second spring is gradually compressed, which may keep a pushing force toward the marble.

A lower end of the cavity 7 is provided with an opening, and the magazine may be loaded from the opening at the lower end of the cavity. After loading, the first through hole of the magazine is aligned with the second through hole of the bow body.

The bow body is also provided with a positioning structure for the magazine. When the magazine is installed in the cavity, the positioning structure ensures that a loading depth of the magazine is a specified depth, thus ensuring that the first through hole is aligned with the second through hole of the bow body.

The first embodiment of the positioning structure includes a positioning piece 13 movably installed on the bow body through a third spring 12, and a positioning groove 17 matched with the positioning piece 13 is arranged on the magazine. After the magazine is loaded, the positioning piece 13 is matched with the positioning groove to position the magazine under an action of the third spring, a fourth through hole is opened at the side part of the bow body, the positioning piece is installed into the fourth through hole through the third spring, and a plugging piece is arranged at an outer end of the fourth through hole. The second embodiment of the positioning structure may be magnets assembly installed on the bow body and the magazine respectively, which position the magazine by magnetic attraction, and are not shown in the figure.

Both sides of an upper part of the bow body 1 are respectively provided with a supporting end, and rubber bands on both sides of the pouch are connected with the bow body after passing through the supporting ends on the corresponding sides of the bow body 1. One side close to a middle of the supporting end is provided with a reset groove 19, and both supporting ends of the bow body are provided with guiding components 14 for the rubber bands. When the pouch is in the state of being launched, the other end of the rubber band is connected with the bow body after passing through the corresponding guiding component 14, and the upper end part of the rubber band is located in the reset groove 19 in a relaxed state. The design of the reset groove 19 may better realize that the pouch is stably located at the opening 3 of the initial position after the pouch is released, and the marble is closer to the pouch after being expelled, which may be better absorbed by the magnet and facilitate automatic loading.

The other end of the rubber band is introduced into the bow body after passing through the corresponding supporting end. Of course, the other end of the rubber band may also be arranged at a proper position outside the bow body. Preferably, an accommodating space 15 for accommodating the rubber band is arranged inside the bow body, and two upper openings at an upper part of the accommodating space 15 are respectively located at the two supporting ends. This arrangement may realize that the rubber band is partially hidden in the bow body, and avoid the exposed rubber band from affecting the reset of the pouch. The accommodating space 15 may be arranged in a channel shape. The other end of the rubber band is fixed in the accommodating space or a lower open end of the accommodating space, and the fixing mode is not limited. The accommodating space 15 may be correspondingly provided with pulleys for guiding the rubber band, which are not shown in the figure.

The pouch is a T-shaped pouch, which is convenient for the user to grasp.

The guiding component 14 may be set as a pulley, which may guide the rubber band by rolling, so that the rubber band may be pulled out more smoothly, the rubber band may be launched more smoothly, and the rubber band may also be automatically retracted into the bow body better.

The embodiments of the present application described above do not limit the scope of protection of the present application. Any modifications, equivalent substitutions, and improvements made within the spirit and principle of the present application shall all fall within the scope of protection claimed by the present application.

The invention claimed is:

1. A magazine-type slingshot, comprising:

a bow body, configured for mounting a pouch and elastic band assembly, the pouch and elastic band assembly comprising a pouch configured to receive a projectile ball and an elastic band configured to propel the projectile ball;

wherein the bow body comprises a magazine disposed therein, the magazine having an opening and being configured for storing projectile balls, wherein the bow body further comprises a projectile ball driving assembly configured for driving at least one projectile ball within the magazine to move toward the opening and causing the projectile ball closest to the opening to be expelled from the opening; and wherein an upper side of the bow body defines a pouch initial position, wherein when the elastic band of the mounted pouch and elastic band assembly is in an unstretched state, the pouch is in the pouch initial position, and wherein when the projectile ball is driven to be expelled from the opening, the projectile ball automatically moves toward the pouch initial position to be received by the pouch at the pouch initial position.

2. The magazine-type slingshot according to claim 1, wherein the projectile ball, when expelled from the opening, moves toward the pouch initial position with a certain initial velocity.

3. The magazine-type slingshot according to claim 1, wherein the magazine comprises a retractable opening operative to automatically retract after being opened, and wherein when the projectile ball is expelled from the opening, the opening retracts to assist the expelled projectile ball to bounce to the pouch initial position.

4. The magazine-type slingshot according to claim 1, wherein a magnet is arranged on the pouch, and the projectile ball is made of a material operative to be attracted by the magnet.

5. The magazine-type slingshot according to claim 4, wherein two sides of the upper part of the bow body each comprise a supporting end, and elastic bands disposed on both sides of the pouch are connected with the bow body after passing through the respective supporting ends on the two side of the bow body.

6. The magazine-type slingshot according to claim 5, wherein an accommodating space for accommodating the elastic band is arranged inside the bow body, and two upper openings at an upper part of the accommodating space are respectively located at the two supporting ends.

7. The magazine-type slingshot according to claim 1, wherein there is arranged an elastic piece in the magazine, the elastic piece being configured to exert a pushing force on the projectile ball in the magazine to move the projectile ball toward the opening.

8. The magazine-type slingshot according to claim 1, wherein the projectile ball driving assembly comprises a driving component movably installed at a side of the bow body through an elastic component, wherein one end of the driving component is operative to extend into the magazine to drive at least one projectile ball in the magazine to move toward the opening, and wherein the magazine defines a first through hole corresponding to the driving component.

9. The magazine-type slingshot according to claim 8, wherein the projectile ball driving assembly further comprises a limiting component, and after the elastic component makes the driving component leave the magazine, the limiting component keeps the driving component at an initial position through limiting.

10. The magazine-type slingshot according to claim 8, wherein an inner end of the driving component comprises a pressing surface that is non-parallel to a moving track of the pressing surface and that is configured to push the projectile ball, and the projectile ball is expelled from the opening by being pressed by the pressing surface.

* * * * *